US006033495A

United States Patent [19]

McGowan et al.

[11] Patent Number: 6,033,495

[45] Date of Patent: Mar. 7, 2000

[54] AQUEOUS GEL COMPOSITIONS AND USE THEREOF

[75] Inventors: Nancy M. McGowan, Sturgeon; John Hahn, Columbia, both of Mo.

[73] Assignee: Elisha Technologies Co LLC, Moberly, Mo.

[21] Appl. No.: 09/016,462

[22] Filed: Jan. 30, 1998

Related U.S. Application Data

[60] Provisional application No. 60/045,462, May 2, 1997, and provisional application No. 60/036,027, Jan. 31, 1997.

[51] Int. Cl.[7] ..... C23C 8/08

[52] U.S. Cl. ..... 148/279; 148/240; 427/397.7; 106/14.21

[58] Field of Search ..... 148/240, 279, 148/248; 252/315.6; 427/397.7, 397.8; 106/14.21, 14.39

[56] References Cited

U.S. PATENT DOCUMENTS

| | | | |
|---|---|---|---|
| 1,608,775 | 11/1926 | Daniels et al. | 148/279 |
| 3,372,038 | 3/1968 | Coatings | 106/1 |
| 3,908,066 | 9/1975 | Parkinson | 428/379 |
| 3,912,548 | 10/1975 | Faigen | 148/6.15 R |
| 4,185,001 | 1/1980 | Machurat et al. | 260/42.37 |
| 4,230,496 | 10/1980 | Falcone, Jr. et al. | 106/14.21 |
| 4,344,860 | 8/1982 | Plueddemann | 252/389 R |
| 4,370,255 | 1/1983 | Plueddemann | 252/389 A |
| 4,479,824 | 10/1984 | Schutt | 106/74 |
| 4,791,008 | 12/1988 | Klotz et al. | 427/397.7 |
| 5,068,134 | 11/1991 | Cole et al. | 427/397.7 |
| 5,108,793 | 4/1992 | van Ooij et al. | 428/623 |
| 5,200,275 | 4/1993 | van Ooij et al. | 428/623 |
| 5,221,371 | 6/1993 | Miller | 148/273 |
| 5,262,464 | 11/1993 | Koevenig et al. | 524/413 |
| 5,292,549 | 3/1994 | van Ooij et al. | 427/156 |
| 5,338,434 | 8/1994 | Ruhl et al. | 205/229 |
| 5,348,579 | 9/1994 | Jenkins et al. | 106/406 |
| 5,667,845 | 9/1997 | Roberto et al. | 427/337 |
| 5,698,087 | 12/1997 | Bokisa | 205/254 |
| 5,705,050 | 1/1998 | Sampson et al. | 205/687 |
| 5,744,521 | 4/1998 | Takasaki et al. | 523/404 |
| 5,746,812 | 5/1998 | Muller et al. | 106/10 |
| 5,750,596 | 5/1998 | Gam | 523/404 |
| 5,759,372 | 6/1998 | Reuter et al. | 204/500 |
| 5,769,967 | 6/1998 | Dolan | 148/247 |
| 5,795,372 | 8/1998 | Hill et al. | 106/14.41 |
| 5,846,342 | 12/1998 | Aoyama et al. | 148/271 |

*Primary Examiner*—John Sheehan
*Assistant Examiner*—Andrew L. Ottmans
*Attorney, Agent, or Firm*—Michael K. Boyer

[57] ABSTRACT

The disclosure relates to aqueous-based gels and, in some cases, usage of such gels to impart corrosion resistance to steel and/or zinc containing surfaces, e.g., galvanized steel. The gel comprises water, at least one thickener, at least one silica containing material and an optional surfactant.

23 Claims, 1 Drawing Sheet

AQUEOUS GEL COMPOSITIONS AND USE THEREOF

The subject matter herein claims benefit under 35 U.S.C. 111(a), 35 U.S.C. 119(e) and 35 U.S.C. 120 of Provisional patent application Ser. No. 60/045,462, filed on May 2, 1997; and U.S. Provisional Patent Application Ser. No. 60/036,027, filed on Jan. 31, 1997; both of which are entitled "Aqueous Gel Compositions and Use Thereof". The disclosure of the aforementioned provisional patent applications are is hereby incorporated by reference.

FIELD OF THE INVENTION

The instant invention relates to aqueous-based gels and, in some cases, usage of such gels to impart corrosion resistance, for example, to steel or zinc containing surfaces, e.g., galvanized steel. The gel comprises water, at least one thickener, at least one inorganic material and an optional surfactant.

BACKGROUND OF THE INVENTION

The corrosion of steel and other metal containing products continues to be a serious technical problem which has profound effects on the economy. Corrosion causes loss of natural resources, and deteriorates key infrastructure such as roads and buildings. It also causes premature replacement of equipment and parts in industrial facilities, boats and other marine vehicles, automobiles, aircraft, among a wide range of metallic components.

Current industry standards for corrosion prevention center around the use of barrier coatings, sacrificial coatings, alloys containing heavy metals such as chromium, nickel, lead, cadmium, copper, mercury, barium, among other heavy metals. The introduction of these materials into the environment, however, can lead to serious health consequences as well as substantial costs to contain or separate the materials or clean up environmental contamination. Damage associated with corrosion, accordingly, is a continuing problem and better systems for preventing corrosion are still needed.

SUMMARY OF THE INVENTION

The instant invention solves problems associated with conventional technologies by providing an aqueous based gel which can protect metals from corrosion in a manner that is compatible with the environment, non-flammable and cost-effective.

The aqueous gel comprises or consists essentially primarily of water. The gel comprises water, at least one thickener, at least one silicate containing material and an optional surfactant. In some cases, the thickener may interact with one or more of the gel components and/or the metal surface, e.g., to form a metal substrate-thickener bond such as a zinc-organo product. e.g. zinc organo carboxylate. The gel can also include other components so long as these components do not adversely impact the viscosity or corrosion protection capabilities of the gel.

The gel can be prepared by using conventional methods and technologies. The gel can be applied or coated upon a metal containing surface by using any expedient method such as aerosol spray, dipping, painting, among other suitable conventional methods. In one aspect of the invention, the coating method can be enhanced by applying an electrical current or other suitable source of energy. Depending upon the thickness of the coating and surrounding environment, the inventive gel can protect a metal surface from corrosion, e.g., salt water spray. If desired, the inventive gel can be employed as relatively temporary coating upon a metal surface.

CROSS-REFERENCE TO RELATED PATENTS AND PATENT APPLICATIONS

The subject matter of the instant invention is related to copending and commonly assigned Non-Provisional U.S. patent application Ser. Nos. 09/016,853, 08/850,586; 08/850,323 (Attorney Docket Nos. EL001RH-8, EL001RH-7 and EL001RH-6), filed respectively on even date herewith and 08/791,337 and 08/791,336 (Attorney Docket Nos. EL001RH-5 and EL001RH-4), filed on Jan. 31, 1997 in the names of Robert L. Heimann et al., as a continuation in part of Ser. No. 08/634,215 (Attorney Docket No. EL001RH-3 filed on Apr. 18, 1996) in the names of Robert L. Heimann et al., and entitled "Corrosion Resistant Buffer System for Metal Products", which is a continuation in part of Non-Provisional U.S patent application Ser. No. 08/476,271 (Attorney Docket No. EL001RH-2 filed on Jun. 7, 1995) in the names of Heimann et al., and corresponding to WIPO Patent Application Publication No. WO 96/12770, which in turn is a continuation in part of Non-Provisional U.S. patent application Ser. No. 08/327,438, now U.S. Pat. No. 5,714,093 (Attorney Docket No. EL001RH-1 filed on Oct. 21, 1994).

The subject matter of the instant invention is also related to Non-Provisional patent application Ser. No. 09/016,250 (EL001DP-1), filed on even date herewith and entitled "An Electrolytic Process For Forming A Mineral" The disclosure of the previously identified patent applications and publication is hereby incorporated by reference.

DETAILED DESCRIPTION

Figure 1:
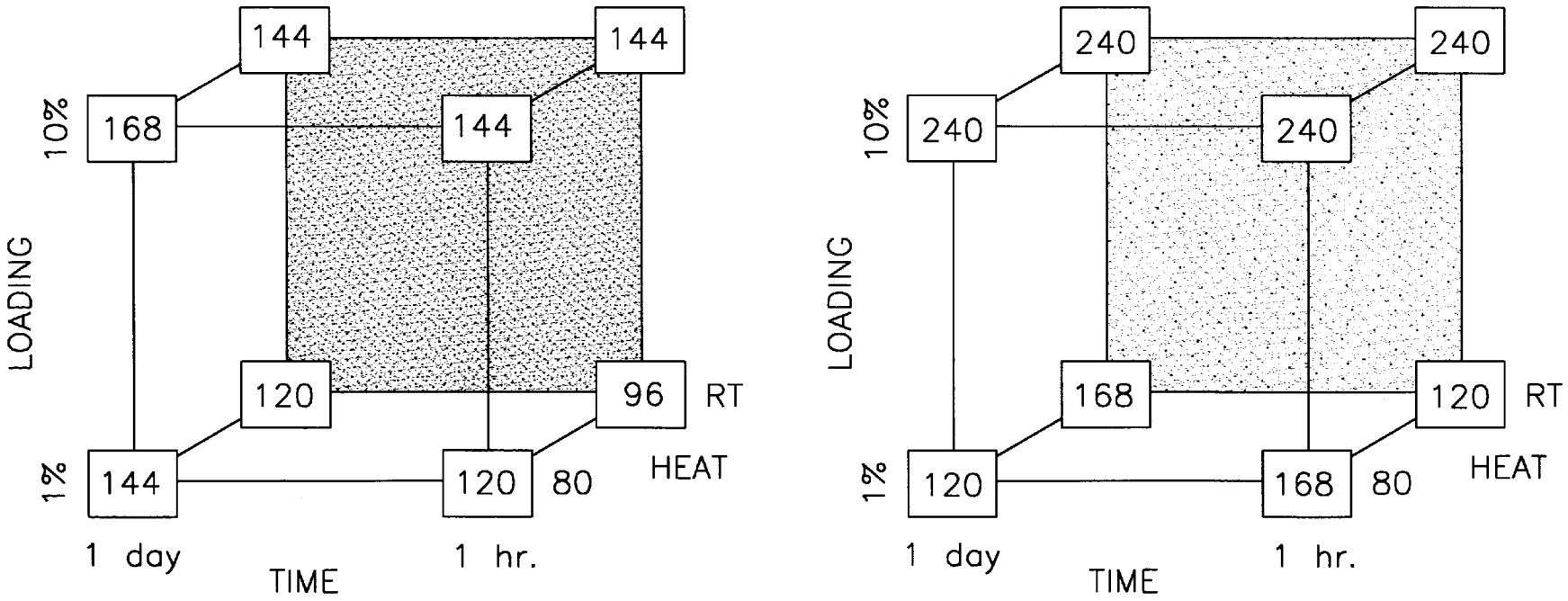
FIG. 1 is a cube plot, which illustrates the ability of the inventive gel to provide corrosion protection from a salt spray. The cube on the left corresponds to a dried gel whereas the cube on the right corresponds to an undried gel.

The inventive aqueous gel comprises or consists essentially of water, at least one thickener, at least one inorganic material and an optional surfactant. The gel can contain from about 80 to about 99.9 weight percent water, and normally about 95 wt. % water.

One or more thickeners can be employed as a component of the gel in order to increase the viscosity of the water. In some cases, the thickener may interact with one or more of the gel components and/or the metal surface, e.g., to form a metal substrate-thickener bond such as a zinc-organo product. While any suitable thickener can be employed, for best results the thickener is stable at a pH from about 9 to about 12 and has a relatively high ionic strength. Examples of suitable thickeners comprise one or more members from the group consisting of an aliphatic polymer with carboxylic acid groups, e.g., CARBOPOL supplied by B. F. Goodrich, xantham gum, silica, synthetic minerals, e.g., LAPONITE supplied by Southern Clay Products, mixtures thereof, among others. The specific amount of thickener is dependent upon the composition of the thickener(s); but, normally the total amount will range from about 0.05 weight percent to about 20 weight percent. When the previously identified aliphatic polymer is employed, the thickener corresponds to about 0.5 to about 2.0 wt. % and normally about 1.0 wt. % of the gel.

The inventive gel can also include one or more organic compounds for modifying or tailoring the characteristics of the gel. In one aspect, the protection of the aqueous gel is enhanced by the presence of other functional groups, e.g., thiolacetic and maleic anhydride functional polymers. Other variations in the functional polymer include the frequency of the repeating acetate groups and the use of maleic anhydride to increase the effective number of zinc-oxygen bonds as well as adding grafted compounds. In another method of improving protection, a polymer grafted onto a polyacrylic acid is introduced to the gel. Without wishing to be bound by any theory or explanation, it is believed that the aforementioned organic compounds; especially the grafted compounds, would be hydrophobic thereby repelling water and imparting enhanced protection to the underlying compounds, materials and substrates.

The aqueous gel can also include at least one inorganic material. Normally, the inorganic material comprises at least one silica containing material such an alkali silicate such as sodium or potassium silicate. While the cost and handling characteristics of sodium silicate are desirable, at least one member selected from the group of water soluble salts and oxides of tungsten, molybdenum, chromium, titanium, zircon, vanadium, phosphorus, aluminum, iron, boron, bismuth, gallium, tellurium, germanium, antimony, niobium (also known as columbium), magnesium and manganese, mixtures thereof, among others can also be employed. Particularly desirable results have been achieved by using salts and oxides of aluminum and iron, which can be employed along with a silicate. All of the claims require a silica containing material. When sodium silicate is employed, desirable results can be achieved by using G or N grade sodium silicate supplied by Philadelphia Quartz (PQ) Corporation. While either G or N grade materials can be employed, in some cases, increased corrosion resistance is obtained by using N grade silicate, e.g, N grade is a dissolved version of G grade. The amount of inorganic material will vary depending upon the thickener; but, normally about 3 to about 5% by weight of silicate is effective, e.g., the gel can contain about 5 wt. % of G grade sodium silicate which is a mixture containing about 37% by weight sodium silicate.

In one aspect of the invention, the aqueous gel further comprises one or more surfactants. While any suitable surfactant can be employed, for best results the surfactant is non-ionic. An example of a suitable surfactant comprises SURFYNOL supplied by Air Products Corporation. The surfactant(s) can comprise about 0.01 to about 10 weight percent of the gel.

In another aspect of the invention, the gel comprises relatively small amounts of additives such as colorants, curing agents, antifungal or antimicrobial agents, metal ions, e.g., zinc, among other substances that have no adverse impact on the viscosity or corrosion protection properties of the gel.

The gel can be prepared by using any expedient method. Typically, the thickener is dispersed into deionized water and agitated for about 5 to 10 minutes. Agitation is not a key aspect of the invention and can be performed by using a suitable method. The inorganic material, e.g., sodium silicate, is added to the dispersion thereby causing an increase in pH. The high pH dispersion is again agitated in order to ensure thorough mixing of the gel's components thereby forming the inventive aqueous gel. If desired, the pH of the gel can be increased further by adding an alkaline material such as at least one member selected from the group consisting of sodium hydroxide, potassium hydroxide, triethanolamine, ammonium hydroxide mixtures thereof, among others. The pH of the prepared gel typically ranges from about 10 to about 11.

The gel can be applied to a virtually unlimited array of substrates such as galvanized steel, stainless steel, aluminum, lead, iron, copper, brass, alloys thereof, among others. Particularly desirable results have been achieved by using a sodium silicate containing gel for protecting a zinc containing surface or alloy from the corrosive affects of salt spray. If desired, the gel can be removed from the substrate, e.g, by rinsing or spraying with water.

While any suitable method can be employed for contacting a substrate with a gel, an example of a suitable method includes passing an electrical current through the gel and substrate during application. That is, a gel applicator apparatus is in contact with a source of electricity and when the gel within the applicator contacts a substrate an electrical circuit is complete. The gel applicator can be of any suitable design that dispenses the gel in a controlled manner, e.g., comprising a porous dispensing terminal member such as a sponge that is in fluid contact with a gel reservoir. The electrical energy to the gel applicator can be supplied via a connection to the applicator itself or the substrate to be coated with the gel.

The gel must be sufficiently conductive to permit current can flow between the electrode and the working piece. Normally, the voltage applied through the gel is about 6 to at least about 18 V and a current density of about 0.1 to at least about 0.5 amps/in2; but, the voltage can be tailored to satisfy a wide range of end-uses. While a gel having any suitable viscosity can be employed, normally the gel must be viscous enough to remain upon the substrate to be treated.

Moreover, the substrate can be contacted with the gel in accordance with the electroylic methods disclosed in copending and commonly assigned U.S. Non-provisional patent application Ser. No. 09/016,250 (Attorney Docket No EL008-1), filed on even date herewith and entitled "Electrolytic Process for Making a Mineral". That is, a substrate is immersed in the inventive gel and a current is applied to the gel. As dicussed above, the current can enhance the formation rate of a corrosion resistant mineral layer upon the substrate.

The aforementioned gel application method can be employed for the general purpose of applying a corrosion resistant material as well as for particular end-uses. Examples of such end-uses include a pretreatment for a metallic surface prior to painting, E-coating, plating, repair damage to a metallic surface, among other uses.

The incubation time of the gel, that is, the time the gel is allowed to be in contact with the substrate can affect the corrosion resistance. For example, increasing the incubation time has a tendency to cause an increase in corrosion resistance. While the incubation time can vary depending upon other operating parameters, normally the incubation time will range from about 1 sec to about 24 hours. The temperature during incubation as well as the temperature when the gel-treated substrate is exposed to a corrosive environment can also affect the corrosion resistance. Normally, the incubation temperature ranges from about 20 to about 100° C.

Time and temperature can also control the removal rate of water and in turn the aforementioned reaction. For example, when the gel is dried upon the substrate, then the increased concentration of a zinc silicate, higher temperature and longer contact time will drive the reaction forward. Consequently, it is believed that water serves a dual role in this process. The first role of water is as a product and by LeChatelier's Principle, removal of the water will drive the reaction forward. The second role of water is as a reaction medium in that the gel is aqueous based.

The corrosion resistance of the gel can be affected by heat and the length of time undried gel is permitted to remain on the surface of the substrate (incubation time). That is, the effectiveness of the gel can be varied depending upon whether or not the gel is dried when exposed to a corrosive environment, the length of time the gel remained upon the substrate prior to removal or being dried, and the temperature of corrosive environment. For example, a relative increase in gel contact time can permit the aforementioned reaction to proceed further, and heat will increase the kinetic energy of the reactants thereby increasing the reaction rate.

In connection with a zinc containing surface or alloy and without wishing to be bound by any theory or explanation, it is believe that the following reaction can occur between a silicate containing gel and the zinc surface thereby forming a mineral surface:

$$A_xB_aO_b\text{–}nH_2O$$

The value of x can vary widely as a function of the amount of reactants present and processing environment, e.g., at a sufficiently high temperature a condensation reaction can occur which yields water as a product. The values of a and b can also vary, but the empirical ratio of b:a is always 4:1 or lower and a and b cannot be 0. In this case, the mineral comprises a zinc silicate containing reaction product, e.g. a layer comprising an amorphous matrix surrounding crystalline zinc-silicate compounds, can form a film or layer upon the surface of the substrate thereby imparting improved corrosion resistance among other properties, e.g., at room temperature a zinc silicate containing monolayer can form in less than about 2 hours. It is also believed that in some cases, the aforementioned reaction includes an organic component such as an organic thickener thereby forming a zinc organo silicate product. If desired, water within the gel as well as reaction product water can be removed by heating, e.g, at temperature from about 50 to about 100° C. thereby increasing the relative concentration of zinc silicate product and improving corrosion resistance, e.g., the gel is dried while in contact with the substrate.

In a further aspect of the invention, at least a portion of the crystalline component of the mineral layer that is surrounded or incorporated within the amorphous phase comprises:

$$M_xM'_yM''_z(Si2O7)_A(SiO3)_B(Si_4O11)_C(Si4O10)_D(OH)s(A)_w(A')_v\text{–}nH_2O$$

where M, M', and M" are ions of Group I, II and/or III metals, and A and A' are the previously defined anions and where v, w, x, y, and z each can be any number including zero but x, y and z cannot all concurrently be zero. Analogously, A, B, C and D can each be any number including zero but cannot all concurrently be zero. "n" is the water of hydration and normally ranges from about 0 to about 10; and typically, ranges from about 0 to 6. "S" is an interger that ranges from about 0 to about 4. At least one of M, M' and M" is a metal supplied from the substrate in contact with the mineralized layer, and normally up to two of M, M' or M" corresponds to an alkali or alkaline earth metal, e.g, calcium, potassium, sodium and mixtures thereof. Without wishing to be bound by any theory or explanation, it is believed that the presence of alkali cations, e.g, M", can influence the presence of other metal ions, e.g., M' supplied from the metal substrate, by an exchange or a replacement mechanism. For example, when the metal substrate comprises zinc and a precursor comprises sodium silicate the crystalline component, which is embedded within the amorphous matrix to form the mineralized layer, comprises $$Zn_xNa_yMz(Si2O7)_A(OH)_S{*}nH_2O.$$

Additional information regarding the mineral layer can be found in the aforementioned commonly assigned patents and patent applications; already incorporated by reference. To enhance mineral layer formation on at least a portion of the surface of a metal substrate, the metal surface may need to be prepared or pretreated. Metal surfaces normally tend to be covered with a heterogeneous layer of oxides and other impurities. This covering can hinder the effectiveness of the buffering and/or mineral layer formation. Thus, it becomes useful to convert the substrate surface to a homogenous state thereby permitting more complete and uniform mineral layer formation. Surface preparation can be accomplished using an acid bath to dissolve the oxide layers as well as wash away certain impurities. The use of organic solvents and detergents or surfactants can also aid in this surface preparation process. Phosphoric acid based cleaners, such as Metal Prep 79 (Parker Amchem), fall into a category as an example commonly used in industry. Other combinations of acids and cleaners are useful as well and are selected depending upon the metal surface and composition of the desired mineral layer. Once the surface is pretreated, the surface can then be subjected to further activation, if necessary, to enhance the buffering capability, including but not limited to oxidation by any suitable method. Examples of suitable methods comprise immersion in hydrogen peroxide, sodium peroxide, potassium permanganate, mixtures thereof, among other oxidizers.

The corrosion resistance can also be affected by pretreating the substrate, e.g., steel or zinc, using a process comprising the following procedure:

1. immerse panel in solution comprising 25% Metalprep 79 (Parker-Amchem) for 2 minutes,
2. remove Panel and rinse with deionized water,
3. immerse panel in 0.1 M NaOH solution for at least about 10 seconds,
4. wipe off excess NaOH solution,
5. immerse panel in 50% H2O2 solution for at least about 5 min., and;
6. wipe off excess hydrogen peroxide. While particularly desirable results have been achieved by using so-called Metalprep, any suitable cleaner such as phosphoric acid can be employed. Normally, the acid cleaner is neutralized by subsequently exposing the acid cleaned substrate to any suitable basic substance. After neutralizing the acid, the cleaned/neutralized surface is oxidized by being exposed to any suitable oxidizer such as hydrogen peroxide, KMnO4, mixtures thereof, among other conventional metal oxidizing compositions.

In another aspect of the invention, the inventive composition comprises a gel which is employed for providing temporary corrosion protection of a finished metal surface, e.g., as a processing step just prior to storage or shipment of a material. Upon reaching its destination or removal from storage, the coating could be removed from the metal article by rinsing with water. The gel could also contain an acrylic, which would allow for either a physical removal, such as peeling, or an immersion in a solution, which would permit the breakup of the coalesced acrylic. One specific example of employing the gel for such a usage comprises applying the gel when producing zinc galvanized coiled steel. After the galvanization process and just prior to the coiling process, this gel can be applied. The gel imparts enhanced corrosion protection to galvanized steel so that the coil can be delivered to its final destination, wherein the gel-coating may be removed by any of the aforementioned methods.

While the above description places particular emphasis upon using the gel for corrosion protection, a skilled person in this art would understand that the gel can be employed in a wide range of end-uses. Examples of such end-uses include as a coolant when extruding metals wherein the corrosion and heat resistant properties of the gel are desirable, a temporary coating for storing or transporting metallic articles such as coiled metal sheets, among other end-uses. Further, prior to completely curing or drying the gel, the gel can be readily removed by rinsing thereby permitting usage of the gel as a temporary protectant. The gel can be applied or reapplied as appropriate for the particular end-use. The properties of the gel can also be tailored to satisfy a virtually unlimited range of end-uses, e.g, tailoring the silicate concentration in the gel and drying the gel.

The following Examples are provided to illustrate certain aspects of the invention and do not limit the scope of the invention as defined in the appended claims. The water employed was deionized water. Unless noted otherwise, all materials referenced in the following Examples were commercially available. The XPS data in the following Examples demonstrates the presence of a unique organozinc species, e.g., XPS measures the binding energies of the atoms and compares the measured energy to standardized values in order to determine bonding properties.

EXAMPLE 1

In the following Example, panels comprising electro zinc galvanized steel (supplied by ACT Laboratories), and measuring about 3" by about 5" inches were tested in accordance with ASTM B-117.

All panels were prepared by rinsing twice with reagent alcohol. Panels were taken from ACT lot# 30718614. The matrix with the salt spray results can be seen below in Table A-1.

A 10% solution of Carbopol polymer was prepared (10 g in 80 g water). After the polymer was hydrated in the water, the appropriate amount of sodium silicate solution was added (3–10% or 3 to 10 g into the solution) while stirring. The pH was then adjusted as needed to 11 using a 10% wt solution of NaOH and topped off with water to reach a total weight of 100 g thereby forming the gel.

The gel was applied to the test panels by the so-called gate method for applying a wet film of 1/16 in. The apparatus for these methods includes a "stick", or piece of plastic with a groove cut into it. Gel is applied onto a panel (by hand) and the the stick is slid over the panel thereby removing any excess gel so that only a 1/16 inch layer of gel remains on the panel.

Once the gel was coated upon the panels, the coated panels were heated. Heating was carried out in a "Crock" Pot containing deionized water. Four panels were placed into the pot upon an upright rack and temperature was recorded at 90° C. Relatively long incubation times were carried out in a covered pan to avoid drying the gel.

The gel was dried upon the surface of certain test panels. Drying was done in a vacuum oven with no heat. Pressure was dropped 25 in Hg. Drying took approximately 1.5 hrs.

Testing time in the salt spray chamber was determined by measuring the time until 5% coverage of Fe2O3 appeared on the test panels. The presence of red rust was determined visually. The longer the period in the salt chamber prior to the appearance of red rust corresponds to improved corrosion resistance.

TABLE A-1

| GEL DRY | TEMP | SILICATE (WT. %) | INCUB TIME | CHAMBER TIME (SALT SPRAY) |
|---|---|---|---|---|
| No | RT | 1% | 1 day | 120 |
| Yes | RT | 1% | 1 day | 168 |
| No | 90 | 1% | 1 day | 144 |
| Yes | 90 | 1% | 1 day | 120 |
| No | RT | 10% | 1 day | 144 |
| Yes | RT | 10% | 1 day | 240 |
| No | 90 | 10% | 1 day | 168 |
| Yes | 90 | 10% | 1 day | 240 |
| No | RT | 1% | 1 hr | 96 |
| Yes | RT | 1% | 1 hr | 120 |
| No | 90 | 1% | 1 hr | 120 |
| Yes | 90 | 1% | 1 hr | 168 |
| No | RT | 10% | 1 hr | 144 |
| Yes | RT | 10% | 1 hr | 240 |
| No | 90 | 10% | 1 hr | 144 |
| Yes | 90 | 10% | 1 hr | 240 |

Table A-1 also shows the length of time within the salt spray chamber until the appearance of 5% red rust. The results shown in Table A-1 are also shown by the cube plot of FIG. 1. Referring now to FIG. 1, the cube on the left is a plot for undried gels whereas the cube on the right is for dried gels. The vertical axis ("y" axis) on both cubes is silicate loading or percent silicate in the gel, i.e., from about 1% to about 10% by weight sodium silicate solution that corresponds to about 0.3 to about 3 wt % sodium silicate in the gel. The horizontal axis ("x" axis) refers to the length of time the gel was permitted to remain on the surface of the panels prior to being exposed to the salt spray, i.e., that ranges from 1 hour to 1 day. The axis into the plane of the paper ("z" axis) plots the temperature of the salt spray, which ranges from room temperature (RT) to about 90° C. The comers of the cubes document the length of time in hours that the test panel remained in the salt spray chamber until the appearance of red rust. A dried gel having about 10 wt. % sodium silicate, e.g obtained the greatest resistance to corrosion, the upper corners of the right-hand cube of FIG. 1.

EXAMPLE 2

The method of Example 1 was repeated with the exception that the test panels comprised steel panel which was electrozinc galvanized (also known as E-GALV-gal and corresponds the steel panels employed in the automotive industry). The panels were coated with an inventive aqueous gel comprising 3% sodium silicate, 1% Carbopol polymer solution at a thickness of 1/16 inch. The coated panel was heated in an oven at a temperature of 175° C. for 30 min. The panel was removed from the oven and place into a salt spray chamber the next day, and tested in accordance with ASTM B117. The panel was exposed to the salt spray for a period of 648 hours before 5% red rust.

EXAMPLE 3

The method of Example 2 was repeated with the exception that the coated panel was allowed to incubate for 1 week at ambient temperature and conditions. The panel is placed into the salt spray chamber and was exposed for a period of 600 hours before the appearance of 5% red rust.

EXAMPLE 4

Two electrozinc galvanized steel panels (ACT Laboratories) were coated with the following formulation: 3 wt % N-grade Sodium Silicate Solution (PQ Corp), 0.5 wt % Carbopol EZ-2 (BF Goodrich) in DI water. This gel was applied at a 1/16 inch wet film thickness using an adjustable drawdown blade. The coated panels were heated at 125° C. for 1 hour. The panels were allowed to set overnight and the excess residue was washed off the panel with deionized water. Panel 2 was exposed to 24 hours salt spray exposure according to ASTM B117 methods whereas Panel 1 not processed further and employed as standard for comparison to the salt exposed Panel 2.

X-ray Photoelectron Spectroscopy (XPS or ESCA) analysis in accordance with standard procedures was performed on these two panels. Panel #1 shows the presence of silica indicated by the Si(2p) photoelectron binding energy of 103.2 eV. The small intensity of the Zn (2p3/2) photoelectron indicates a presence of a relatively small amount of zinc. The sampling depth of this type of analysis is 50 angstroms thereby indicating that these data indicate an accumulation of the silica on top of the zinc surface.

Panel 2 was used to characterize the zinc surface. The salt spray exposure washed away the excess build up of silica and silicate to expose a deeper profile. ESCA analysis reveals the presence of a build up of an organic carbon substance. The C (1s) photoelectron binding energies of 289 and 291 eV representing a multi-faceted carbon, organo-anion. The Zn(2p3/2) photoelectron binding energy at 1023.45 eV indicated the presence of a zinc acetate species.

The above ESCA data gives two conclusions. The first is the formation of an organo zinc species, comprised of zinc and the aforementioned Carbopol thickener.

The Carbopol comprises a polyacrylic acid thickener, which contains repeating carboxylic acid functional groups. Without wishing to be bound by any theory or explanation it is believed that the presence of basic material, e.g., sodium silicate, deprotonates the acid groups thereby leaving an acetate functionality (R—COO—). It is also believed that this functional group can react with the zinc surface and form the previously identified zinc acetate species found on the surface. The second conclusion is the continued deposition of silica once the organo-zinc species was formed. In contrast, Panel #1 shows no zinc or organic carbon signatures; the only species present was a silica or silicate.

Without wishing to be bound by any theory or explanation, it is also believed that Example 4 illustrates the formation of a zinc acetate bond and Example 5 illustrates the formation of an iron acetate bond. The presence of a steel or zinc acetate type of bond has been confirmed by XPS analysis. The bond formation is believed to be due at least in part to the polymeric nature of the thickener. Because the polymer contains repeating carboxylate groups, it is believed that there are many "anchor" sites for the polymer to lay on the surface. If one of the zinc acetate bonds should break, the polymer may possess at least two functionalities in close proximity, facilitating the reforming of the bond. Such indicates that maleic anhydride and/or any suitable polyacrylic acid, or functional equivalent can be employed as a thickener in accordance with the instant invention.

It is also believed that the multi-point anchoring nature of an polyacrylic acid provides enhanced desirable corrosion protection (among other valuable properties) by using a relatively large number of bonds with the underlying substrate in comparison to other organic thickeners. It is also believed that incorporating a water-born urethane would permit two types of surface reactions. Establishing conditions sufficient to cause two competing reactions within one inventive composition may produce two types of zinc formations on the surface, namely, a zinc disilicate and a zinc acetate. This formula would incorporate the robust bonding of the silicate while retaining the multipoint anchoring of the acetate polymer.

EXAMPLE 7

The following formulation is applied as a coating that provides improved corrosion protection to a metal containing surface. The coating can form a self-supporting layer upon the metal surface. If desired, the self-supporting coating is removed from the metal surface by being peeled or stripped from the surface.

| AMOUNT | COMPONENT | SUPPLIER |
|---|---|---|
| 90 wt. % | PL-958 acrylic | B.F. Goodrich |
| 10 wt. % | N-grade sodium silicate | PQ Corp. |
| 0.5 wt. % | sodium nitrite | Fisher Scientific |

EXAMPLE 8

This Example illustrates using an electrical current for applying the inventive gel onto a substrate. The coated substrate was analyzed by using ESCA to confirm formation of a mineral layer, e.g, a reaction product formed between the substrate and the gel.

An aqueous gel was made by admixing by hand 5% sodium silicate and 10% fumed silica. The gel was used to coat cold rolled steel panels (supplied from ACT). One panel was washed with reagent alcohol, while the other panel was washed in a phosphoric acid based metal prep, followed by a sodium hydroxide wash and a hydrogen peroxide bath.

The apparatus was set up using a DC power supply connecting the positive lead to the steel panel and the negative lead to a platinum wire wrapped with glass wool. This setup was designed to simulate a brush plating operation. The "brush" was immersed in the gel solution to allow for complete saturation. The potential was set for 12 V and the gel was applied in a painted motion onto the panel with the brush. As the brush passed over the surface of the panel, hydrogen gas evolution could be seen. The gel was brushed on for five minutes and the panel was then washed with DI water to remove any excess gel and unreacted silicates.

An ESCA analysis performed in accordance with conventional techniques was used to determine the surface characteristics of each steel panel. ESCA permits examination of any reaction products between the metal substrate and the environment set up from the electrolytic process. Every sample measured showed a mixture of silica and metal silicate. The metal silicate is a result of the reaction between the metal cations of the surface and the alkali silicates of the coating. The silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

The following is claimed:

1. A method for reducing the corrosion rate of a metal containing surface, comprising the steps of:

providing the metal containing surface, applying at least one layer comprising an aqueous basic gel comprising at least one silica containing material, a thickener and an ionic surfactant upon said surface, heating the surface to a temperature to cause an interaction between the gel and surface thereby reducing the corrosion rate of the surface.

2. A method for reducing the corrosion rate of a metal containing surface, comprising the steps of;

providing the metal containing surface, applying at least one layer comprising an aqueous basic gel comprising at least one silica containing material upon said surface, passing an electrical current through at least one of the gel and the surface, optionally heating the surface to a temperature, and recovering the metal containing surface wherein the surface has an improved corrosion resistance.

3. A method for reducing the corrosion rate of a metal containing surface, comprising the steps of:

providing the metal containing surface wherein said metal containing surface comprises zinc, contacting the surface with an aqueous basic coating comprising at least one silica containing material, reacting at least a portion of the aqueous basic coating with the metal containing surface thereby forming a mineral upon the metal containing surface comprising crystals embedded with an amorphous matrix; and, recovering the mineral coated metal containing surface wherein said mineral coated metal containing surface has a reduced corrosion rate.

4. A method for treating a metal containing surface, comprising the steps of;

providing the metal containing surface wherein the metal surface comprises zinc, applying at least one layer comprising an aqueous basic gel comprising at least one silica containing material upon said surface, heating the surface to a temperature to cause an interaction between the gel and surface thereby reducing the corrosion rate of the surface.

5. A method for treating a metal containing surface, comprising the steps of:

providing the metal containing surface, contacting the surface with an aqueous basic coating comprising at least one silica containing material, a thickener and an ionic surfactant, reacting at least a portion or the aqueous basic coating with the metal containing surface thereby forming a mineral upon the metal containing surface comprising crystals embedded within an amorphous matrix; and, recovering the mineral coated metal containing surface wherein said mineral coated metal containing surface has a reduced corrosion rate.

6. The method of any one of claims 2, 3 or 4 wherein the aqueous basic coating or gel comprises a combination of water, a thickener, at least one silica containing material and an optional surfactant.

7. The method of any one of claims 2, 3 or 4 wherein the aqueous basic coating or gel comprises a combination of water, at least one thickener, at least one silica containing material and an optional surfactant; wherein the pH of the gel is greater than about 10.

8. The method of any one of claims 1, 2 or 5 wherein the thickener comprises at least one member selected from the group consisting of an aliphatic polymer, xantham gum, and synthetic minerals.

9. The method of any one of claims 2, 3, 4 or 5 wherein the gel or coating comprises about 80 to about 99.9 wt % water.

10. The method of claim 8 wherein the thickener comprises an ionic polymer.

11. The method of any one of claims 1, 2, 3, 4 or 5 wherein the coating or gel further comprises at least one member selected from the group of colorants, surfactants, curing agents, metal powder and antimicrobial agents.

12. The method of claim 11 wherein the surfactant comprises an ionic surfactant.

13. The method of any one of claims 1, 2, 3, 4 or 5 wherein the silica containing material comprises sodium silicate.

14. The method of any one of claims 1, 2, 3, 4 or 5 wherein the surface has a corrosion resistance as defined by ASTM No. B-117 of at least about 96 hours.

15. The method of any one of claims 1, 2, 3, 4 or 5 wherein the gel or coating is heated to a temperature of about 90° C.

16. The method of any one of claims 1, 2 or 5 wherein the surface contains zinc.

17. The method of any one of claim 2 or 4 wherein the aqueous basic coating or gel is obtained by combining water, at least one thickener, silica, at least one silicate and an optional surfactant.

18. The method of claim 2 wherein at least a portion of the metal containing surface is coated with a silicate containing reaction product.

19. The method of claim 18 wherein the silicate containing reaction product comprises crystals embedded within an amorphous matrix.

20. The method of any one of claims 1, 2 or 5 wherein the metal containing surface comprises at least one member selected from the group consisting of galvanized steel, stainless steel, aluminum, lead, iron, copper and alloys thereof.

21. The method of claim 20 wherein the metal containing surface comprises coiled metal.

22. The method of any one of claims 1, 4 or 5 wherein the gel further comprises an acrylic.

23. The method of any one of claims 1, 2, 3, 4 or 5 wherein said gel or coating comprises at least one member selected from the group consisting of sodium hydroxide, potassium hydroxide, triethanolamime, and ammonium hydroxide.

* * * * *